US005568720A

United States Patent [19]

Teich et al.

[11] Patent Number: 5,568,720

[45] Date of Patent: Oct. 29, 1996

[54] APPARATUS FOR SERVICING A MULTI-POSITION YARN WINDING MACHINE

[75] Inventors: Udo Teich, Sprockhovel; Ludger A. Deters, Remscheid, both of Germany

[73] Assignee: Barmag AG, Remscheid, Germany

[21] Appl. No.: 308,583

[22] Filed: Sep. 19, 1994

[30] Foreign Application Priority Data

| | | | |
|---|---|---|---|
| Sep. 17, 1993 | [DE] | Germany | 43 31 597.6 |
| Oct. 6, 1993 | [DE] | Germany | 43 34 020.2 |
| Mar. 3, 1994 | [DE] | Germany | 44 06 994.4 |

[51] Int. Cl.[6] ..... D01H 9/10; D01H 9/14

[52] U.S. Cl. ..... 57/281; 57/90; 57/268; 198/487.1; 242/35.5 A; 242/18 A; 414/626

[58] Field of Search ..... 242/35.5 A, 35.5 T, 242/18 A; 198/485.1, 487.1, 803.12; 414/27, 626, 609, 639, 662, 668–9; 57/90, 281, 268

[56] References Cited

U.S. PATENT DOCUMENTS

| | | | |
|---|---|---|---|
| Re. 31,839 | 2/1985 | Schippers et al. | 57/281 |
| 3,116,586 | 1/1964 | Ingham | 57/268 |
| 3,123,967 | 3/1964 | Ingham | 57/268 |
| 3,593,869 | 7/1971 | Zurheide | 414/626 |
| 3,599,417 | 8/1971 | Zurheide | 57/281 |
| 4,023,339 | 5/1977 | Laderach et al. | 57/268 |
| 4,427,158 | 1/1984 | Conrad | 242/35.5 A |
| 4,621,778 | 11/1986 | Paravella et al. | 242/35.5 A |
| 4,817,373 | 4/1989 | Gualchierani | 57/281 |
| 5,029,762 | 7/1991 | Behrens et al. | 242/18 A |
| 5,059,087 | 10/1991 | Mitani et al. | 414/626 |
| 5,222,856 | 6/1993 | Yamamoto | 57/281 |
| 5,316,126 | 5/1994 | Hirai | 198/487.1 |
| 5,343,687 | 9/1994 | Okuyama et al. | 57/281 |
| 5,398,801 | 3/1995 | Langen et al. | 198/407 |

FOREIGN PATENT DOCUMENTS

| | | | |
|---|---|---|---|
| 0479063 | 9/1990 | European Pat. Off. . | |
| 0531908 | 9/1992 | European Pat. Off. . | |
| 2438363 | 4/1976 | Germany . | |
| 4101339 | 7/1992 | Germany . | |
| 2-291368 | 3/1990 | Japan | 242/35.5 A |
| 3-284586 | 12/1991 | Japan | 242/35.5 A |

*Primary Examiner*—William Stryjewski
*Attorney, Agent, or Firm*—Bell, Seltzer, Park & Gibson, P.A.

[57] ABSTRACT

Doffer system for a textile machine, in particular for a multiposition textile machine, comprising a guiding device (3, 4, 5), which is arranged in front of and above a machine front, a transport unit (14) traveling along the guiding device (3, 4, 5), a hoisting device (17, 19) which allows to lower and raise the carrying frame (20), and at least one receiving mandrel (23, 24) which is arranged on the carrying frame (20) horizontally extending therefrom.

16 Claims, 6 Drawing Sheets

APPARATUS FOR SERVICING A MULTI-POSITION YARN WINDING MACHINE

BACKGROUND OF THE INVENTION

This invention relates to a doffer system for a textile machine. Known from DE 41 01 339 is a doffer in which the wound yarn packages of a textile machine, which are first formed on a spindle, are loaded onto several receiving mandrels of the doffer, and then transported away. Known from EP 0 479 063 is to keep on standby a plurality of individual doffers in a parking track along a textile machine with a plurality of takeup positions, and to call one of the doffers when needed by an individual takeup position. This arrangement results in not only a very simple design of the individual doffers, but also in a 100% availability at the same time, and thus a 100% utilization of the machine, i.e., it cannot happen that a takeup device is not serviced for lack of a doffer capacity. Disadvantageous in the doffer system known from EP 0 479 063 is that the doffer system interferes with the accessibility to the textile machine and that the machine front is covered by one or more doffers.

It is an object of the present invention to further develop the doffer system so as to improve accessibility to the textile machine in a way that the machine front is not covered by one or more doffers.

SUMMARY OF THE INVENTION

In accordance with the invention, this object is accomplished by providing a doffer system having a overhead track arranged in front and above the textile machine front with a transport unit which travels along the overhead track, a carrying frame connected to the transport unit which is raised and lowered by a hoisting device and at least one mandrel extending horizontally from the carrying frame.

This solution has the advantage that, except in its operating position, the doffer travels or is positioned substantially overhead and outside of the range of operation of the machine. It is therefore possible to perform unhindered such operations which continue to be manual. In particular, it is not necessary to provide for as many safety devices for the operating personnel.

This arrangement provides many advantages without requiring a space-consuming construction.

It becomes further necessary to align the carrying frame so that in the servicing position the receiving mandrels are in exact alignment with the spindle of the takeup position. To this end, the carrying frame is arranged on the transport unit for pivoting or rotating thereabout and a carrousel can be arranged on the underside of the transport unit.

If the hoisting mechanism is constructed such that it does not cause a lateral guidance of the carrying frame, at least one pair of clamping devices will be provided to interengage the carrousel and the carrying frame. Each pair of clamping devices has a guide pin arranged on the carrousel and a guide opening in the carrying frame so that the guide pin enters the guide opening when the carrying frame has assumed its uppermost position. These clamping devices secure the carrying frame both in the vertical and in all lateral directions.

The carrying frame of the doffer in accordance with the invention possesses at least one, and preferably two receiving mandrels. The mandrel serves to receive the full yarn packages which are pushed off from the respective working spindle of the takeup position and taken over by the mandrel.

Such an embodiment prevents a further complication of the doffer construction. For this reason, the receiving mandrels are stationarily arranged on the doffer. This construction becomes feasible as a result of the following method of operation:

To begin with, the doffer is lowered to its deepest position, in which the upper receiving mandrel is aligned with the winding spindle carrying full packages. This construction makes it therefore necessary that the winding spindles be arranged relatively high—more than one package diameter—above the plant floor.

After having received the full packages, the carrying frame moves to an intermediate position in which the lower receiving mandrel is aligned with the now empty spindle. The lower receiving mandrel carries empty tubes, which were slipped before onto the mandrel at a tube transfer station. The empty tubes are now pushed onto the spindle. To this end, a suitable pushing mechanism is provided.

A further embodiment of the doffer permits an operation, which is largely adapted to the layout of the takeup device. To this end, the doffer is provided with a mandrel carrier which is pivotal or rotatable. Supported on the mandrel carrier are two receiving mandrels, preferably equally spaced apart from the axis of rotation and offset relative to one another by 180°. This configuration allows the arrangement of the takeup devices of the textile machine such that the spindle with the full packages is located in a very low plane during the doffing. The mandrel carrier of the doffer is then rotated or pivoted, so that an empty receiving mandrel is located at this low level. Subsequently, the full packages are pushed onto the mandrel. Thereafter, the mandrel carrier is rotated by 180°, until the other receiving mandrel carrying empty tubes is in alignment with the spindle. The empty tubes are then pushed onto the spindle.

The doffer of the present invention is especially suitable for cooperating with takeup machines, such as are disclosed in DE 24 38 363 and U.S. Pat. No. 5,029,762. These takeup machines are used for winding in a nonstop operation synthetic filaments yarns as are produced in spinning plants. In operation of each takeup machine, a first winding spindle is in an upper operating position, and a second spindle is in a lower standby position. The fully wound yarn packages on each winding spindle are in the standby position, and they are pushed by this spindle onto the doffer, while new packages are being wound on the other spindle. Since these new packages increase very rapidly, it is necessary to push the full packages very fast onto the doffer after the start of a winding cycle. It is therefore necessary to have the doffer available within a time period of a few minutes after each package doff.

The doffer of the present invention allows the use of a novel logistics system for the supply of empty tubes and/or removal of full packages. Systems of the state of the art require that each takeup position be serviced immediately at the start of a winding cycle, so as to supply the empty tube necessary for the next winding cycle, and/or to transport away the package that was finished in a preceding winding cycle, and to make space for a new package.

The further development of this invention allows the transport of any desired number of carrying frames by means of the overhead transport system, and the delivery of one carrying frame to each position of a desired number of positions on the textile machine. It will then be possible to delay the removal of the full package or the supply of an empty tube for the duration of an entire winding cycle. This allows a substantial reduction in the transport frequency from the front of the textile machine. On the other hand, the doffer is divided into a drive mechanism on the one hand, and a plurality of carrying frames on the other. This results in that only the drive mechanisms are exacting in their technical layout and control, whereas the carrying frames may be designed and constructed in a very simple manner.

A particularly simple layout of the doffers, i.e. the carrying frames, will be feasible when the carrying frames are used only to receive empty tubes and/or full packages, but not to service the machine in any other way. Consequently, space will be required for the other service of the machine in the form of a service aisle.

To this end, the carrying frame 20 is releasably connected with the hoisting device and the carrying frame is movable on a carriage with wheels in a direction toward the takeup positions. Accordingly, each carrying frame is designed for independent movement. To avoid each carrying frame having its own drive mechanism, a gripping mechanism may be arranged on each position of the textile machine and can be extended to and retracted from the carrying frame stationed in front of the machine position.

An alternative provides that in front of each position of the textile machine a linearly guided mechanism is arranged, which can receive a carrying frame.

In accordance with the invention, each carrying frame is provided with one or two mandrels for receiving packages and/or empty tubes. On the other hand, it is also necessary to remove again the packages or tubes from the respective mandrels by pushing them axially to each takeup position of the textile machine, and/or to have a storage device or the like follow. In all these instances, it will be useful that each carrying frame is provided with a corresponding pushing mechanism for each mandrel. An energy supply can be provided at each takeup position for connection with the carrying frame.

BRIEF DESCRIPTION OF THE DRAWINGS

Further advantages and characteristic features of the invention are described with reference to embodiments illustrated in the drawing, in which.

DETAILED DESCRIPTION OF PREFERRED EMBODIMENTS

Figure 2:
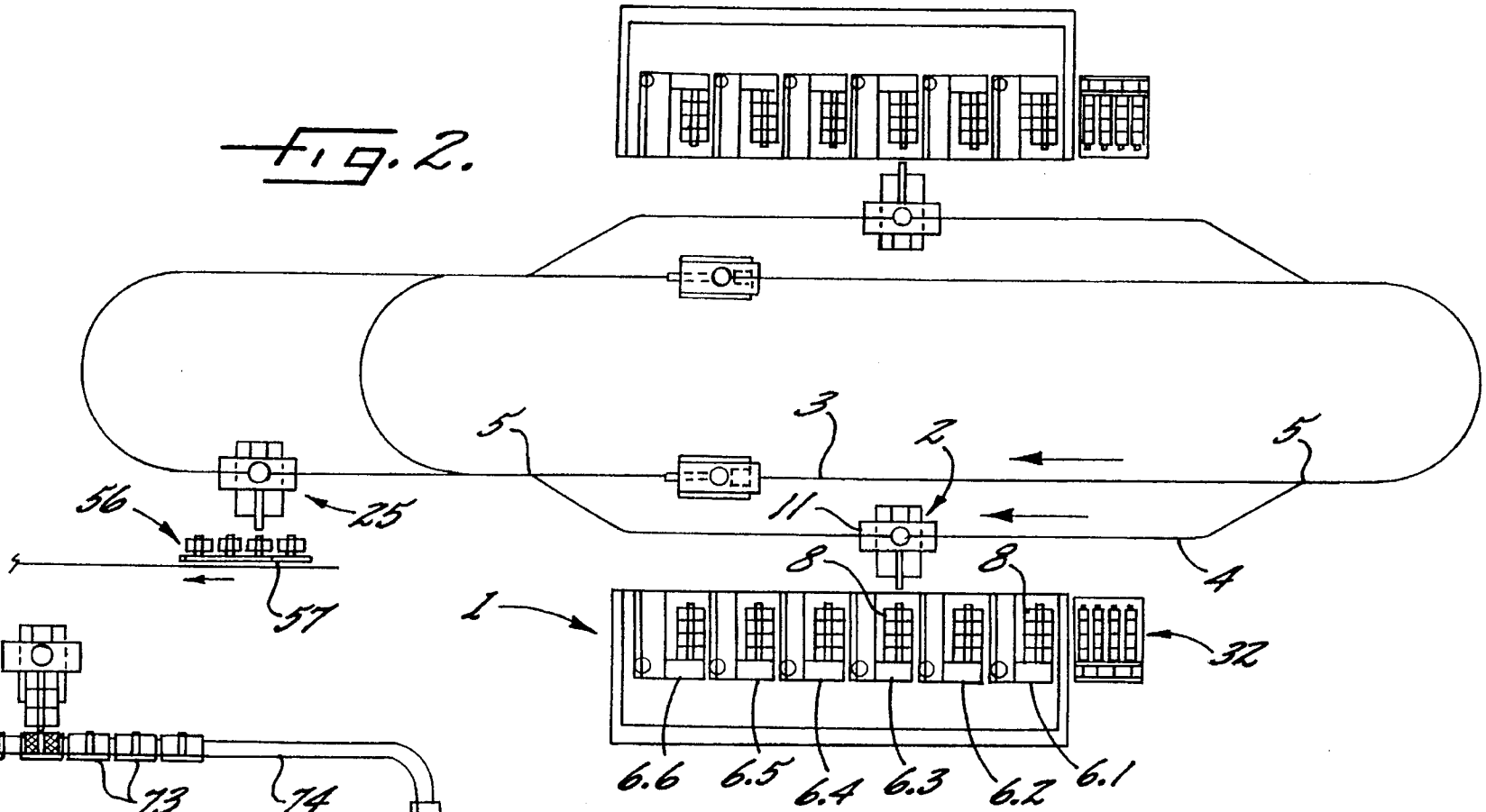
FIG. 2 illustrates a textile machine with a layout of the track network for the doffers.

Referring more particularly to the drawings, FIG. 2 illustrates a yarn winding machine 1, which comprises a plurality of side-by-side winding positions 6.1 to 6.6. Each winding position includes a horizontal winding spindle 7, and each spindle 7 is adapted to coaxially mount four yarn packages 8 to be wound. As illustrated, the packages are in a substantially fully-wound condition. However, it has to be assumed that the winding cycle at each takeup position 6.1, 6.2 . . . is started at different times. Therefore, the winding of the packages on the individual takeup positions is completed likewise at different times.

When at a takeup position 6.1 . . . 6.6 a signal is emitted indicating that the winding cycle is completed and that the packages 7 are fully wound, and likewise, when an individual takeup position signals that the winding cycle must be interrupted for any reason, a signal is released via a signalling network extending throughout the machine room to a plurality of doffers. These doffers 2 are on standby on a main track 3 of a track network which extends below the ceiling 10 of the machine room. The main track 3 is connected via switches 5 to a service track 4. One service track extends along the front of each textile machine 1.

Figure 1:
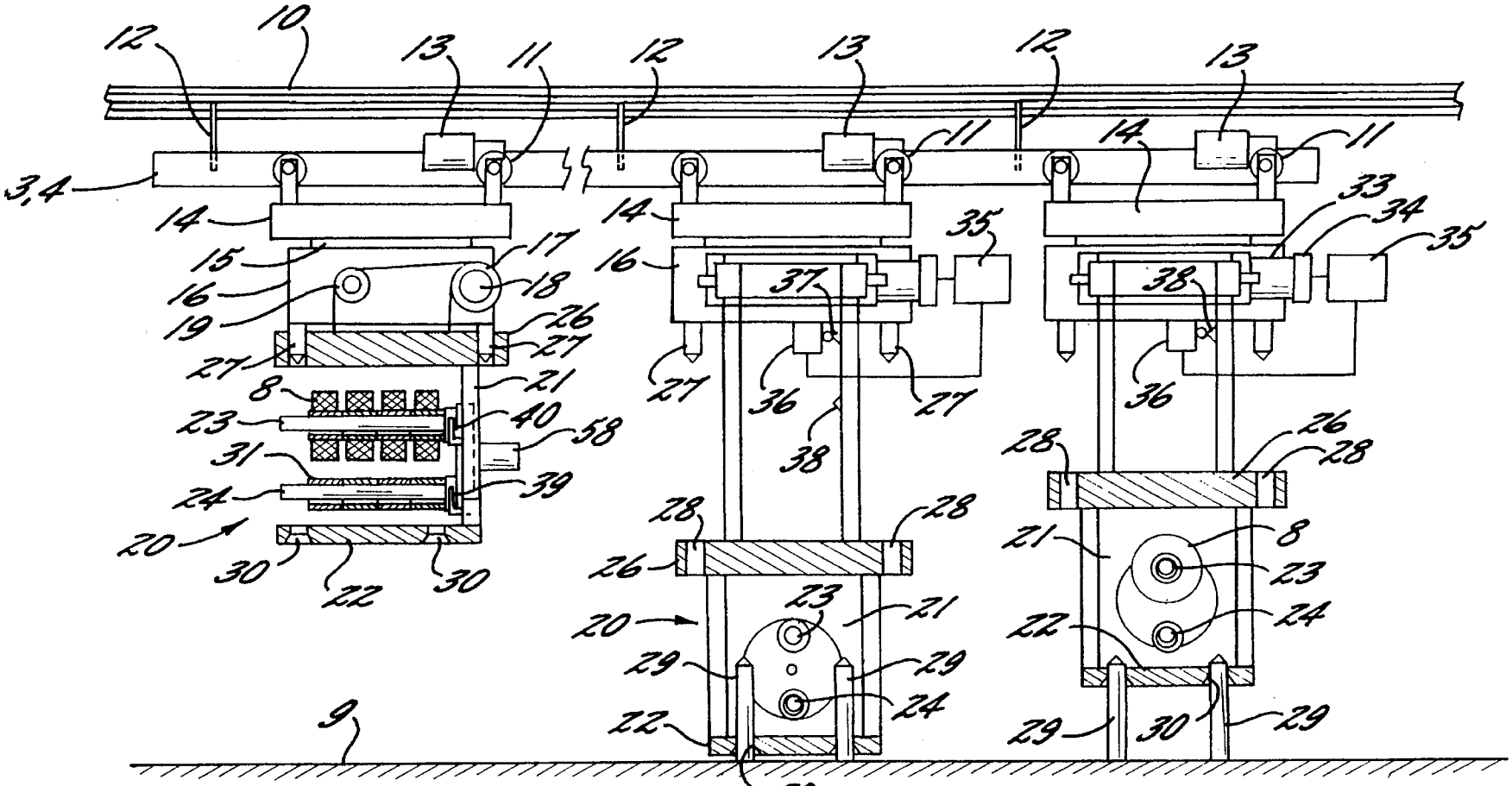
FIG. 1 illustrates the doffer in its different operating/positions.

While on standby and when traveling, each doffer is in the position shown on the left side of FIG. 1. Referring to this position, the doffer as a whole is now described. In the entire installation which includes several textile machines, each doffer being on standby, en route, or in operation, comprises as its essential element an electric overhead conveyor 11. This electric overhead conveyor travels along tracks 3, 4. The tracks are mounted on a bracket 12, so as to suspend from ceiling 10. The electric overhead conveyor is driven by a motor 13 but may also be operated by a battery or by conductor rails via current collectors. In the latter instance, conductor rails will extend parallel to tracks 3, 4 and the electric motor will be equipped with current collectors. In any event, i.e. even when battery-operated, the motor or its control device will however always be connected to a signal line. This signal line is not illustrated. In the place of the signal transmission via a line, it is also conceivable to use a remote signalling.

The electric overhead conveyor is provided with a transport unit 14. Arranged on the underside of this transport unit 14 is a pivot bearing 15, which supports a carrousel 16 with a vertical axis for rotation about the transport unit. The carrousel 16 can perform a rotation about at least 90°, preferably 180° or more. Arranged on the carrousel is a hoisting device 17–19 for a carrying frame 20. The carrying frame 20 can be moved upward and downward by means of the hoisting device. In the present embodiment, the hoisting device consists of a cable winch 17 with a winch beam 18 and a drum 19. A total of four cables are wound on the winch beam. Two of these cables extend from the winch beam directly to cover 26 of the carrying frame. The two remaining cables extend over drum 19 to cover 26 of the carrying frame. In this manner, the cover of the carrying frame is suspended from four points extending over a surface, so that weight shifts in the carrying frame do not lead to any significant tilting of the carrying frame.

Extending from its horizontal cover 26, the carrying frame is provided with a vertical support wall 21. Attached to the bottom of the vertical support wall 21 and horizontally extending therefrom is a centering plate 22. Thus, the carrying frame is open toward three sides. Mounted on support wall 21 are two horizontal receiving mandrels 23 and 24. The latter extend in one vertical plane. The receiving mandrels are adequately spaced apart from one another and from the upper and lower sides of the carrying frame, so as to permit to accommodate on upper receiving mandrel 23 fully wound yarn packages 8 and to also place empty tubes on lower mandrel 24.

In the standby position and when traveling, the carrousel 16 is rotated such that the receiving mandrels 23 and 24 are aligned in the traveling direction. This allows to accomplish that the doffer occupies little space. Furthermore, in these operating conditions, the carrying frame is clamped to the carrousel 16. To this end, the cover 21 is used, which serves in this instance as a clamping plate and forms a part of the clamping device for securing the carrying frame. As a whole the clamping device consists of cover 21, vertical guide openings 28 which extend through ceiling 21, as well as vertical clamping pins 27, which extend from the underside of carrousel 16 and are aligned with clamping openings 28. Likewise used for clamping are the cable lines of the carrying frame. In its upper position, the carrying frame is secured to carrousel 16 such that it cannot move relative to the carrousel either in vertical or in any lateral direction.

By actuating cable winch 17, the carrying frame can be lowered from its clamped position. When one of the takeup positions emits a service signal, as described above, one of the doffers which is nearest travels over switches 5 onto service track 4, and stops as exactly as possible in front of the takeup position. Now, the carrousel 16 is rotated by 90°, so that the receiving mandrels 23 and 24 extend as parallel as possible to spindle 7 of the takeup position. Then, the carrying frame is lowered. During its downward movement, a positioning device sees to it that the carrying frame 20 is positioned and secured so that the upper receiving mandrel 23 is in exact alignment with winding spindle 7 of the takeup position. In the illustrated embodiment, the positioning device consists of a plurality of stationary, vertically extending guide pins 29, which are used to "string up" centering plate 22, which is provided with corresponding guide openings 30. At least two pairs of guide pins 29 and guide openings 30 are needed.

Likewise used for positioning is a brake 34, which is connected with drive motor 33 of cable winch 17. Furthermore, one of the cables is provided with a marking 37, which is scanned by a sensor 36. The marking 37 defines the lowest stopping point of the carrying frame. This precise positioning now allows the full yarn packages to be pushed from the takeup position onto mandrel 23. It should be remarked at this point that the spacing between the upper receiving mandrel 23 and the underside of the centering plate is at most equal to the spacing between the winding spindle to be serviced and the floor of the room. For this purpose, the textile machine is provided with a pushing mechanism (note, for example DE 24 38 363).

Subsequently, it is possible to transfer the empty tubes, which have previously been received by mandrel 24 of the doffer at a supply station, which is located, for example, on the side of textile machine 1. Naturally, it is four individual tubes that are transferred. For the transfer of these tubes, the carrying frame is now raised to an intermediate position. This intermediate position is identified on one of the cables by a marking 38. As the carrying frame moves upward, the sensor 36 detects this marking 38, and thus causes a height positioning of the doffer in the intermediate position. Likewise in this position, however, the positioning device consisting of guide pins 29 and guide openings 30 remains still engaged, so that likewise mandrel 24 is still in alignment with the winding spindle. Now, a pushing mechanism 39 which is concentric with receiving mandrel 24 and movable along the mandrel, pushes the empty tubes onto empty winding spindle 7. The empty tubes are then secured in position, and the spindle is again ready for operation. Thereafter, the carrying frame moves again to its uppermost position (clamping position), where it is secured. Finally, the carrousel is again rotated to its position in alignment with the traveling direction.

The doffer leaves now the service track, after having previously received new empty tubes from a tube loading station 32. It then travels along main track 3 to a transfer station. In the transfer station, the yarn packages are pushed onto a creel, each package being deposited in its own space. This allows the arrangement of the packages in an areal configuration. In this areal configuration, the packages can be moved to a control station.

It should be remarked that also receiving mandrel 23 possesses a pushing mechanism. This pushing mechanism 40 becomes operative when the packages 8 are transferred to the creel. To this end, the pushing mechanism advances in steps, each by one package length, so as to permit to deposit each package 8 in its own space in the creel.

Likewise the tube loading station 32 is provided with a pushing mechanism, so as to slip four empty tubes, respectively arranged on one horizontal mandrel, jointly onto the mandrel 24 of the doffer.

Figure 3:
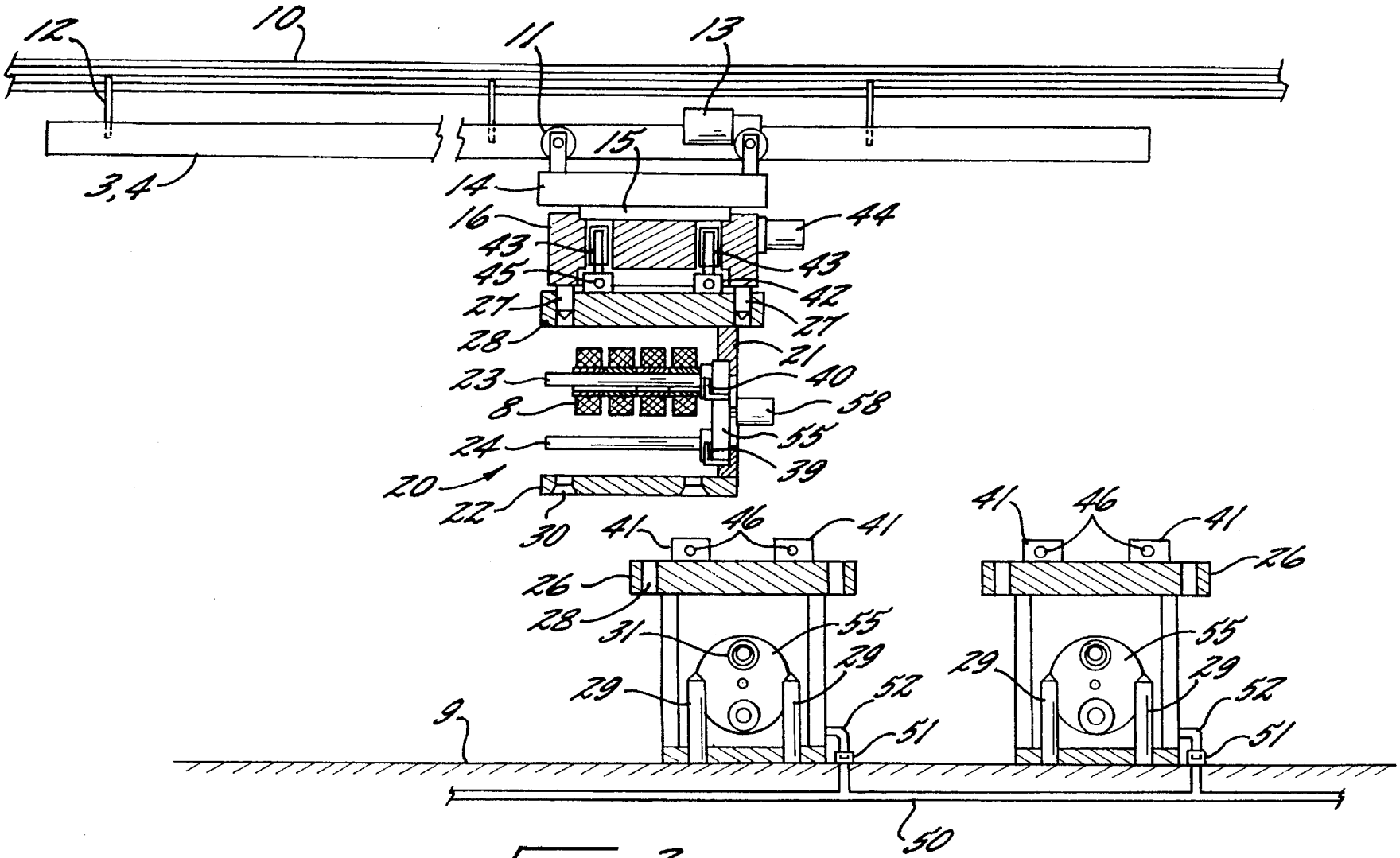
FIG. 3 illustrates a doffer with a lowered carrying frame.

The following description refers to the embodiment shown in FIGS. 3 et seq.

An essential element is an electric overhead conveyor 11. This electric overhead conveyor travels along tracks 3, 4. The tracks suspend from a bracket 12 attached to ceiling 10. The electric overhead conveyor is driven by a motor 13. It may also be operated by a battery or by conductor rails by means of current collectors. In the latter instance, conductor rails will extend parallel to traveling tracks 3, 4, and the electric motor will be equipped with current collectors. However, in any event, i.e., even when battery-operated, the motor or its control device is always connected to a signal line. This signal line is not illustrated in this embodiment. It is likewise conceivable to use a remote signalling in the place of the signal transmission via a line.

Figure 6:
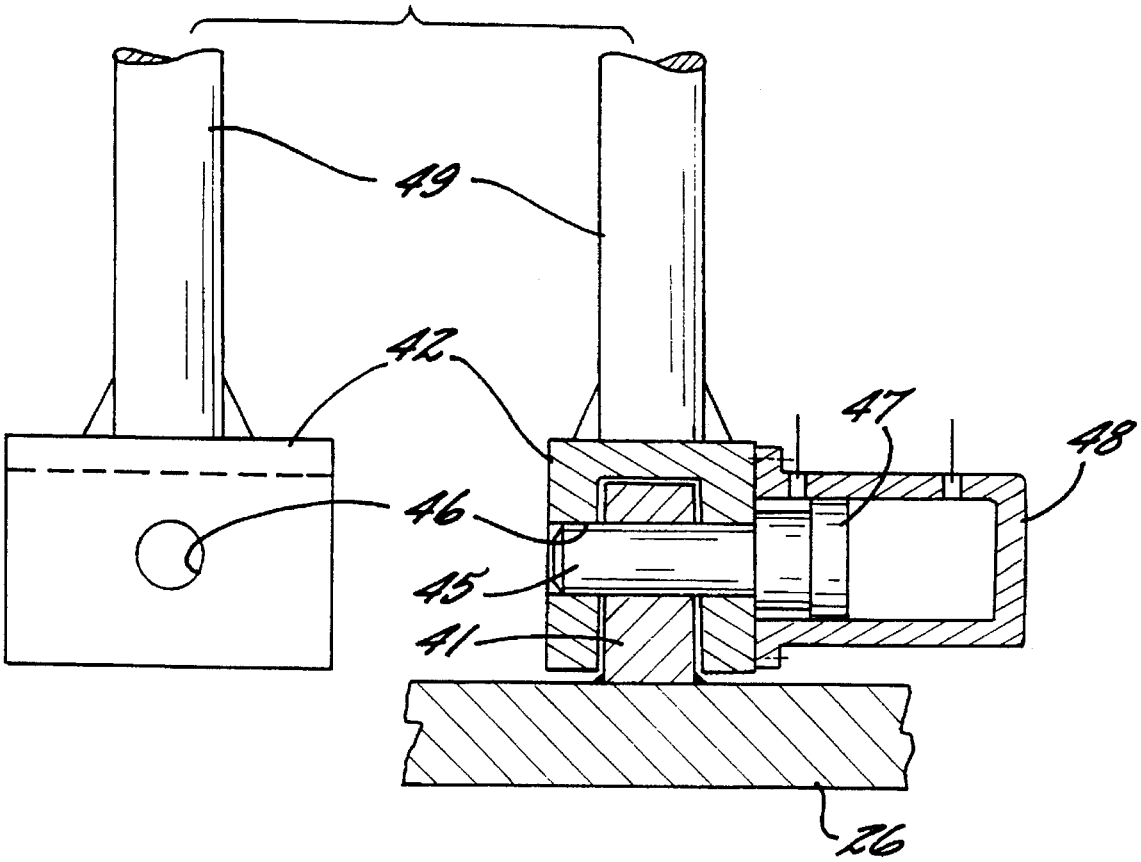
FIG. 6 illustrates a detail of FIGS. 3 and 4.

Arranged on the electric overhead conveyor is a transport unit 14. Located on the underside of this transport unit 14 is a pivot bearing 15, which supports a carrousel 16 for rotation about the transport unit. The carrousel 16 is able to perform a rotation about at least 90°, preferably 180° or more. Arranged on the carrousel is a hoisting device 17–19 for a carrying frame 20. The latter can be moved upward and downward by means of the hoisting device. In the present embodiment, the hoisting device consists of two telescopic cylinders 43. These telescopic cylinders 43 are supplied with compressed air by means of a compressed-air generator 44 via a control not shown and the necessary valves. Arranged at the end of a piston rod 49—see FIG. 6—are holding devices 42. These include in the illustrated embodiment a U-shaped rail. This U-shaped rail matches with a fastening rail 41, which is constructed as a rail in the form of a strip and fits exactly into the inside cross section of U-shaped rail 42. The holding device 42 is further provided with a pneumatic cylinder 48, in which a piston 47 with a holding pin 45 attached thereto is operative. In so doing, the holding pin 45 slides into two aligning eyes 46, which are arranged in the vertical legs of the U-shaped holding device. Such an eye is further provided in fastening rail 41.

The fastening rail is attached to the cover 26 of each carrying frame. To pick up a lowered carrying frame, the telescopic cylinders 43 move out, thereby permitting U-shaped holding rail 42 to slide over each fastening rail 41. In this condition the holding pins 45 are moved out so as to release the U-shaped cross section of the holding rail. Now the pneumatic cylinders 48 are biased by pressure in the opposite direction, so that the holding pins 45 penetrate through eyes 46, thus permitting the carrying frame to be raised, as shown in FIG. 3.

Extending from its horizontal cover 26, each carrying frame is provided with a vertical support wall 21. Attached to vertical support wall 21 at its bottom and horizontally extending therefrom is centering plate 22. Thus, the carrying frame is open toward three sides. Attached for rotation or pivoting to support wall 21 is a mandrel carrier 55. The rotation or pivoting is effected by a motor 58. Attached to mandrel carrier 55 are two receiving mandrels 23 and 24, which extend in a common plane. The spacing between the two receiving mandrels and their distance from the upper and lower sides of the carrying frame is large enough so as to accommodate on the one receiving mandrel the packages 8 in their fully wound condition, and to still further allow to slip empty tubes onto the other mandrel.

When the carrying frame suspends from the transport unit, i.e. in particular in its standby position and while traveling, the carrousel 16 is rotated such that the receiving mandrels 23 and 24 are aligned with the traveling direction. This allows the doffer to occupy little space. Further, in these operating conditions the carrying frame is secured to the carrousel by clamping, in that in this instance, its cover 26 is used as a clamping plate and forms a part of the clamping device for securing the carrying frame. As a whole, the clamping device includes cover 26, vertical guide openings 28, which are formed in the cover 26, as well as vertical clamping pins 27, which are arranged on the underside of carrousel 16, and aligned with the respective openings 28. Also providing the clamping are the telescopic cylinders 43 of the carrying frame. In its uppermost position, the clamping device secures the carrying frame cage to carrousel 16 such that it cannot move relative to the carrousel either in the vertical or in any lateral direction.

The actuation of the telescopic cylinders allows to lower the carrying frame from its clamped position, it being thus possible to place the carrying frame on the floor in front of a takeup position, or onto a linear guideway not shown.

Figure 4:
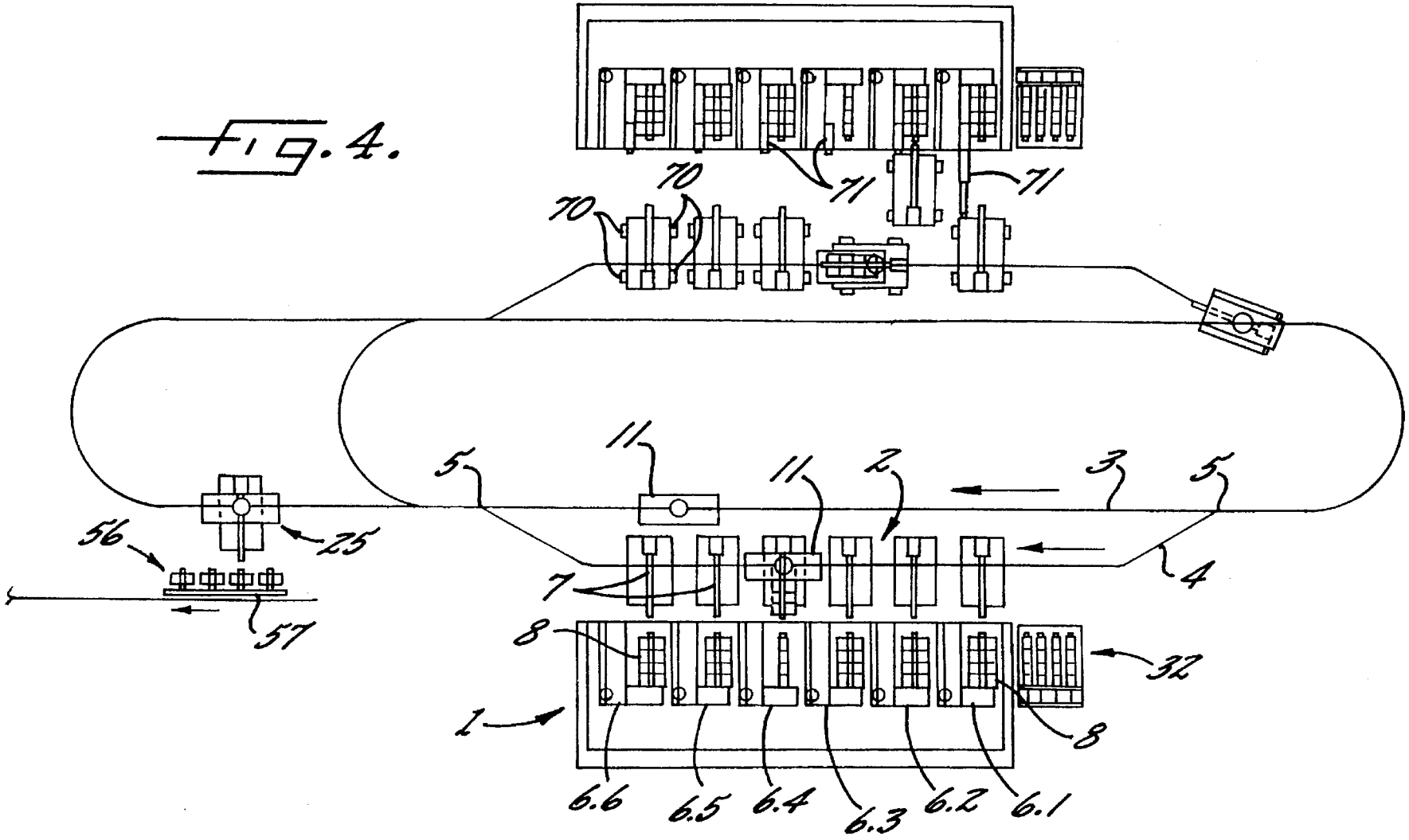
FIG. 4 illustrates the doffer of FIG. 1 with a lowered carrying frame and a carrying frame during transportation.

Once the carrying frame is lowered, the holding pins 45 are removed from eyes 46. It is then possible to retract the telescopic cylinders 43, thus allowing the electric overhead conveyor to travel independently. In this manner, as is shown in FIG. 4, one doffer 2 or its carrying frame is deposited in front of each takeup position 6.1, 6.2 . . . . As shown in the lower portion of FIG. 4, the carrying frame 20 is positioned directly in front of textile machine 1. As a result, the mandrels 23 for receiving the full yarn packages, or mandrels 24 for delivering empty tubes are aligned, almost without any space therebetween, with the spindles of each associated takeup unit of the textile machine. This allows to slip the empty tubes on mandrel 24 onto the spindle, or to push the full packages on the spindle onto mandrel 23. It should be emphasized at this point, the each carrying frame is loaded with empty tubes at tube magazine 32, before it is stationed in front of a takeup position.

Further shown in the lower half of FIG. 4 is that one carrying frame has already been loaded with full yarn packages. Here, one electric overhead conveyor 1 has moved above the carrying frame, so as to pick up same. It should here be emphasized that for this pickup maneuver the entire winding cycle of the respective takeup position is now available. Although the takeup position, as basically all takeup positions within the scope of the present application, is equipped with two spindles which alternate in winding one of more yarn packages during the operation and in removing the packages on standby, in the present embodiment of the invention a time pressure is absent, since the spindle on standby has already delivered its packages to the receiving mandrel 23 of the carrying frame waiting in front thereof. The carrying frames are picked up from the individual takeup positions in a time sequence, in which the packages are fully wound on each takeup position. For the selection of the point in time, however, a long period of time is available.

When the electric overhead conveyor receives a service signal, it travels over switches 5 onto service track 4, and stops as precisely as possible above the carrying frame stationed in front of the takeup position. Now, the telescopic cylinders move out, and, as already described, the carrying frame is coupled to piston rods 49 of the telescopic cylinders. The carrying frame can then be raised and, as already described, be clamped to carrousel Thereafter, the carrousel 16 rotates by 90°, so that the receiving mandrels of the carrying frame are aligned with the traveling direction. At the takeup position, which is still winding a new package, another carrying frame may now be stationed. To this end, an electric overhead conveyor with a carrying frame secured thereto moves first to the tube loading station (tube magazine 32). There, the lower receiving mandrel 24 is loaded with empty tubes, which are slipped from the tube magazine onto the mandrel. Subsequently, the electric overhead conveyor travels in front of the particular takeup position. Now, the carrousel 16 rotates by 90°, so that receiving mandrel 23 and 24 extend as exactly parallel as possible to spindle 7 of the takeup position.

Thereafter, the carrying frame is lowered. A positioning device allows to position and secure the carrying frame 20 as it is lowered such that the upper receiving mandrel 23 is in exact alignment with winding spindle 7 of the takeup position. In the illustrated embodiment, the positioning device employs a plurality of stationary, vertical guide pins 29, which allow to "string up" centering plate 22 that is provided with corresponding guide openings 30. At least two pairs of guide pins 29 and guide openings 30 are needed.

At the same time as the carrying frame is stationed, it is connected to compressed-air network 50 so as to receive energy. To this end, the compressed-air network possesses at each takeup position or stationing place an upwardly open line adapter 51 for each carrying frame. Each carrying frame is positioned such that the connection line 52 of each carrying frame is exactly aligned with and enters into the compressed-air adapter.

When now at this takeup position, the winding cycle is completed and the packages are wound to a predetermined diameter, the package revolver of the takeup position will rotate by approximately 180°. This rotation causes the full yarn packages to move to a standby position, while a new winding spindle is rotated to its operating position. Since the yarns continue to advance, and the empty tubes on the new winding spindle have a small diameter, the packages build up rapidly. For this reason, there is a risk that the new packages build up with their circumference against the old packages now on standby. Therefore, the now full packages are pushed from the winding spindle on standby onto the receiving mandrel of the doffer, which is aligned with the winding spindle on standby. This allows to ensure that the new packages will no longer be able to collide with the old packages. Since the doffer is already waiting in front of the takeup position and ready to receive, the removal of the full packages can proceed very fast. Then, the mandrel carrier 55 of the doffer rotates by 180°, so that mandrel 24 with the empty tubes is moved to a position, in which it is aligned with the winding spindle on standby.

Subsequently, the empty tubes can be removed from the receiving mandrel to the winding spindle on standby.

Regardless of the necessity to doff the packages, the takeup position can continue to operate, in particular, it is possible to further rotate the package revolver which accommodates the winding spindles, as is described in U.S. Pat. No. 5,029,762. The carrying frame may remain stationed in front of the takeup position and be picked up and replaced with another "empty carrying frame" at any desired time during the operation.

In the embodiment shown in the upper half of FIG. 4, each doffer is equipped with wheels 70. Each takeup position is provided with a gripper 71. Each of these grippers is adapted to extend and retract in a direction perpendicular to the machine front. The doffers are placed by the electric overhead conveyor in a standby position, which is spaced apart from the machine front and the electric overhead conveyor associated to the doffer. This allows a service aisle between the line of stationed doffers and the machine front. When now a takeup position is about to complete a winding cycle, the gripper 71 associated to the takeup position moves outward and engages with the doffer. Then, the gripper retracts, and secures the doffer in front of the takeup position such that the lower receiving mandrel is aligned with the lower winding spindle holding the full yarn packages. Now, the full packages can be removed. Subsequently, the mandrel carrier rotates by 180°, and the empty tubes are pushed from the receiving mandrel onto the now empty winding spindle. It should be remarked at this point for all embodiments which employ doffers with mandrel carriers that the mandrel carriers have preferably the same radial dimensions as the package revolver of the takeup machine, which accommodates the winding spindles. This has the advantage that the package carrier can be rotated during the winding cycle, as is the subject matter of U.S. Pat. No. 5,029,762. In this instance, the mandrel carrier may rotate along in the same direction. Thus, the receiving mandrels remain in an aligned connection with the winding spindles. This means it will not be necessary to push the full packages from their winding spindle in a certain position of the winding spindle. Likewise, it will not be necessary to push the empty tubes in a certain rotated position of the mandrel carrier from their receiving mandrel onto the winding spindle.

Figure 5:
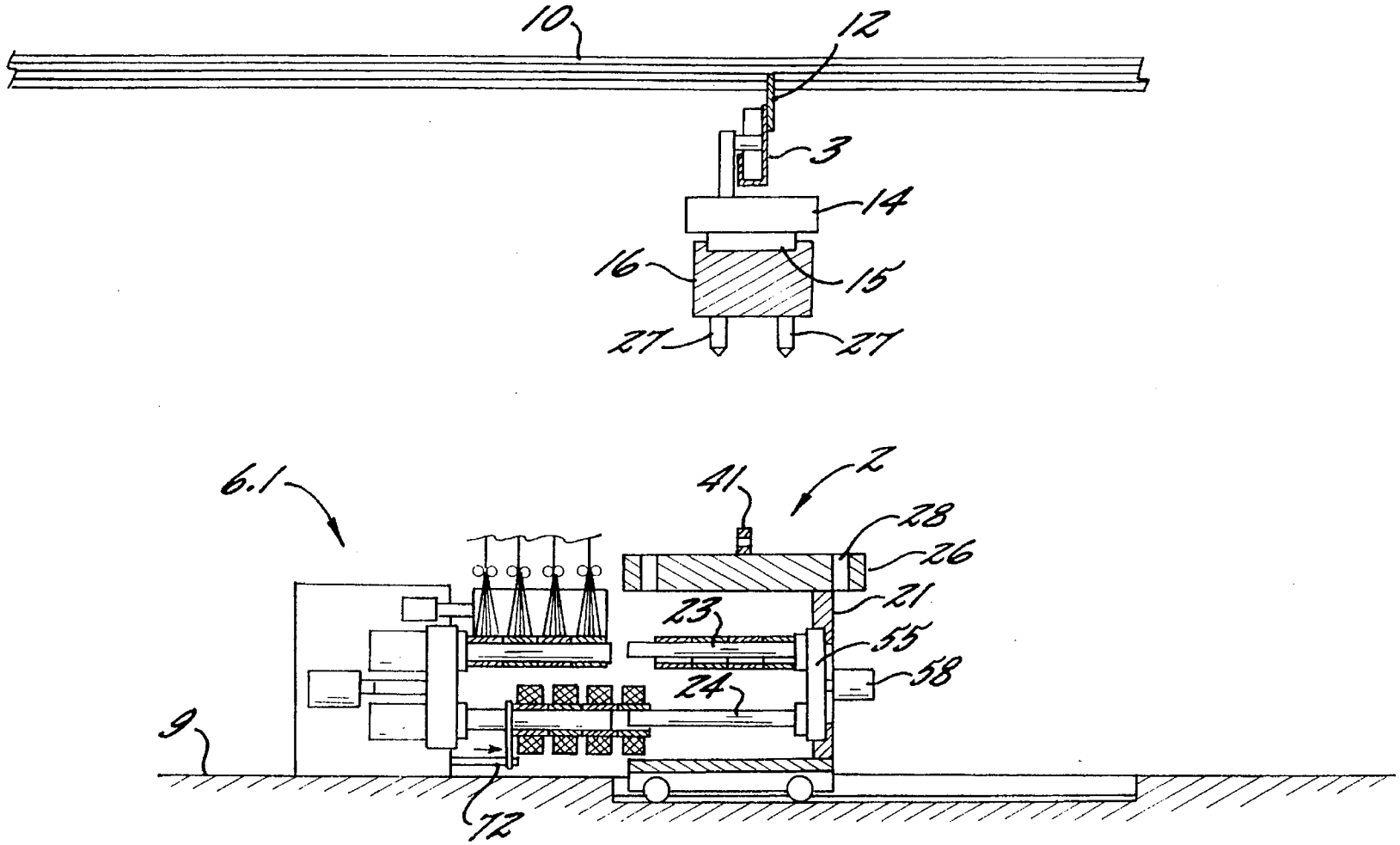
FIG. 5 illustrates the takeup position of a spinning machine with a doffer configured as in FIGS. 3 and 4.

For a better illustration of the transfer of the full packages and the empty tubes between the takeup position and the doffer, the following description refers to FIG. 5.

Shown in FIG. 5 as a portion of a spinning machine is one takeup position 6.1. It is a takeup device, as is described and illustrated, for example, in U.S. Pat. No. 5,029,762. Illustrated is the condition in which the package doff has just been completed. One spindle having received empty tubes is engaged with a contact roll. The four advancing yarns are now being wound on the empty tubes to packages. The full packages are still on the winding spindle being in its standby position. Illustrated is the moment in which the pushing mechanism slides the full packages from the winding spindle onto receiving mandrel 23 of the doffer. The doffer is stationed in front of takeup device 6.1. It possesses a rotatable mandrel carrier 55. The mandrel 23 for the full packages is in a lower plane, in which it is aligned with the winding spindle on standby, so that the full packages can be removed. Further arranged on the mandrel carrier is mandrel 24 holding empty tubes. As soon as the full packages have been received by mandrel 23, the mandrel carrier rotates by 180°, so that mandrel 24 is aligned with the now empty winding spindle on standby. A pushing mechanism on the doffer then slides the empty tubes onto the spindle.

As shown in FIGS. 2 and 4, the doffer delivers thereafter the packages to a creel in a transfer station. Such a creel is a frame that is movable in a suspended or upright position, with a carrying surface accommodating a number of receiving devices, each for one package. The creel is used preferably because it allows to arrange the packages in an areal configuration. This areal configuration again allows to check each individual package for quality defects and for quality classification.

Figure 2A:
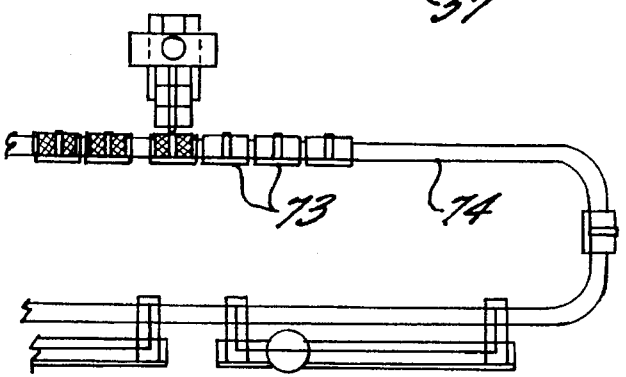
FIG. 2A illustrates an alternative detail of FIG. 2.

However, it is also possible to transfer the package to individual carriers. Each of these individual carriers 73 holds a single package, and forms an independent transport unit with a package creeled thereon. These individual carriers may be transported, for example, along a rollway 74 to a roll station, as can be noted from FIG. 2A. It should be added that the transfer station of FIG. 2A may also be used in the arrangement of FIG. 4. As to details of this individual carrier, one may refer in particular to U.S. Pat. No. 5,398,801.

That which is claimed:

1. An apparatus for servicing a multiposition textile processing machine and comprising an overhead track which is positioned along a front side of the textile machine, a transport unit mounted for movement along said track, a pivotable carrousel, means for mounting said carrousel to the underside of said transport unit wherein the carrousel is selectively pivotable about a vertical axis with respect to said transport unit, a carrying frame which mounts at least one horizontally disposed mandrel, hoisting means interconnecting the carrying frame to the carrousel and so that the carrying frame is selectively lifted and lowered with respect to the carrousel between a raised position adjacent the carrousel and a lowered position, and means interengaging the carrousel and the carrying frame so as to prevent relative lateral movement therebetween when the carrying frame is in said raised position.

2. The apparatus as defined in claim 1 further comprising guide means fixedly mounted along the front side of the textile machine for accurately positioning the carrying frame with respect to the textile machine when the carrying frame is in said lowered position.

3. The apparatus as defined in claim 1 wherein said interengaging means comprises at least one vertical opening positioned in one of said carrousel and said carrying frame, and at least one pin mounted to the other of said carrousel and said carrying frame, with said opening being positioned to receive said pin when said carrying frame is lifted to said raised position.

4. The apparatus as defined in claim 1 wherein said interengaging means comprises a cover mounted to said carrying frame, at least one vertical opening formed in said cover, and at least one vertical pin mounted to said carrousel, with said opening being positioned to receive said pin when said carrying frame is lifted to said raised position.

5. The apparatus as defined in claim 1 wherein said hoisting means comprises a hoisting member mounted to said carrousel, and means interconnecting said hoisting member and said carrying frame.

6. The apparatus as defined in claim 5 wherein said hoisting member comprises a rotatable drum, and wherein said interconnecting means comprises at least one cable extending from said drum to said carrying frame.

7. The apparatus as defined in claim 5 wherein said hoisting member comprises a telescopic rod, and said interconnecting means comprises a releasable connection between said rod and said carrying frame.

8. The apparatus as defined in claim 7 wherein said carrying frame includes support wheels for supporting the carrying frame for rolling movement along a floor surface when said carrying frame is in said lowered position and said connection with said rod is released.

9. The apparatus as defined in claim 1 further comprising a drive motor mounted to said transport unit for advancing the transport unit along said overhead track.

10. The apparatus as defined in claim 1 wherein said carrying frame mounts a pair of vertically spaced apart horizontally disposed mandrels.

11. A textile yarn processing apparatus comprising a package winding apparatus comprising a plurality of yarn winding machines, with each of the machines including at least one winding spindle, and with the machines positioned in a side by side arrangement and so as to define a machine front which faces the spindles of the machines, an overhead track positioned to extend along the machine front of the package winding apparatus, a transport unit mounted for movement along said track, a pivotable carrousel, means for mounting said carrousel to the underside of said transport unit wherein the carrousel is selectively pivotable about a vertical axis with respect to said transport unit, a carrying frame which mounts at least one horizontally disposed mandrel, hoisting means interconnecting the carrying frame to the carrousel and so that the carrying frame is selectively lifted and lowered with respect to the carrousel between a raised position adjacent the carrousel and a lowered position, and means interengaging the carrousel and the carrying frame so as to prevent relative lateral movement therebetween when the carrying frame is in said raised position.

12. The apparatus as defined in claim 11 further comprising guide means fixedly mounted along said machine front of the package winding apparatus for accurately positioning the carrying frame with respect each of said yarn winding machines when the carrying frame is in said lowered position.

13. The apparatus as defined in claim 11 wherein said hoisting means comprises at least one telescopic rod mounted to said carrousel, and means releasably interconnecting said telescopic rod and said carrying frame.

14. The apparatus as defined in claim 13 wherein said carrying frame includes support wheels for supporting the carrying frame for rolling movement along a floor surface when said carrying frame is in said lowered position and said releasable interconnecting means is released.

15. The apparatus as defined in claim 14 further comprising a guideway mounted adjacent each of said yarn winding machines and so as to extend in a direction perpendicular to said machine front, with each such guideway being configured to receive and guide the support wheels of a lowered and released carrying frame, and gripper means mounted to each of said yarn winding machines for engaging a lowered and released carrying frame and rolling the same along said guideway toward and away from the associated yarn winding machine.

16. The apparatus as defined in claim 11 wherein each of said yarn winding machines comprises a turret which is rotatable about a horizontal axis and which mounts a pair of parallel winding spindles, and wherein said carrying frame mounts a pair of parallel mandrels on a carrier which is rotatable about a horizontal axis, and so that the pair of mandrels can be respectively aligned with the pair of spindles.

* * * * *